United States Patent [19]

Yoshida et al.

[11] Patent Number: 4,879,951

[45] Date of Patent: Nov. 14, 1989

[54] INK SUPPLYING DEVICE

[75] Inventors: Kouichi Yoshida, Machida; Noritake Harada, Kanagawa, both of Japan

[73] Assignee: Kabushikigaisha Tokyo Kikai Seisakusho, Tokyo, Japan

[21] Appl. No.: 259,771

[22] Filed: Oct. 19, 1988

[30] Foreign Application Priority Data

Oct. 28, 1987 [JP] Japan ..... 62-272816

[51] Int. Cl.[4] ..... B41F 31/08

[52] U.S. Cl. ..... 101/363; 101/366

[58] Field of Search ..... 101/364, 350, 366, 207, 101/208, 209, 210, 349, 167, 363, 487, 488; 210/175; 346/75; 137/340; 118/666, 667, 620, 202, 58, 64

[56] References Cited

U.S. PATENT DOCUMENTS

| | | | |
|---|---|---|---|
| 2,971,460 | 2/1961 | Shindle | 101/426 X |
| 3,065,693 | 11/1962 | Neal et al. | 101/366 |
| 3,207,070 | 9/1965 | Klingler et al. | 101/366 |
| 4,007,684 | 2/1977 | Takano et al. | 101/366 |
| 4,337,469 | 6/1982 | Takano et al. | 101/366 |
| 4,373,443 | 2/1983 | Matalia | 101/363 |
| 4,384,523 | 5/1983 | Ryan | 101/364 |
| 4,625,643 | 12/1986 | Davis | 101/366 |
| 4,754,779 | 7/1988 | Juhasz | 101/364 |

*Primary Examiner*—J. Reed Fisher

*Attorney, Agent, or Firm*—Foley & Lardner, Schwartz, Jeffery, Schwaab, Mack, Blumenthal & Evans

[57] ABSTRACT

The present invention relates to an ink supplying device adapted for a rotary press used for printing news papers. More particularly, the present invention relates to an ink supplying device comprising an inking cylinder, an ink feeding means for feeding ink to the inking cylinder, and an ink temperature control means for controlling the temperature of the ink to be fed to the inking cylinder within the optimum range.

The temperature control means comprises a medium circulating unit including a medium chamber, a medium temperature detecting unit, a heater and a cooler; a heat exchanger; a pipe system for circulating between the medium circulating unit and the heat exchanger; and an ink temperature detecting unit.

The heat exchanger is preferably selected from plate type heat exchangers.

This system allows that the ink temperature is quickly adjusted to the optimum range for printing work and further always maintained within the optimum range during its printing work.

11 Claims, 7 Drawing Sheets

INK SUPPLYING DEVICE

BACKGROUND OF THE INVENTION (1) Field of the Invention

The present invention relates to an ink supplying device adapted for a rotary press used for printing news papers. More particularly, the present invention relates to an ink supplying device especially adapted for specific types such as an off-set type printer, which is provided with an ink circulation system between an ink supplying unit and an ink reservoir, and an ink temperature control system.

(2) Description of the Prior Art

Conventional ink supplying devices provided with an ink circulation system between an ink supplying unit such as an ink fountain and a fountain roller and an ink reservoir such as an ink tank have been disclosed in Japanese Patent Publication No. 35-12862 and U.S. Pat. No. 4,384,523. In detail, the former invention teaches one type of ink circulation system comprising an overflow wall formed on an ink tank (or ink fountain) and a conduit pipe adjacent to it. The conduit pipe is communicated with a main ink tank (or ink tank) so that ink is fed from the main ink tank to the ink tank through a pump and overflowed ink is fed back to the main ink tank through the conduit pipe from the overflow wall. This prior art is a typical example of a basic ink supplying device with an ink circulation system. This circulation system provides an effect that the ink stored in the ink fountain can be kept at the constant level and further the stagnation of the ink in the fountain is not generated by the circulating flow. However this device is not free from some problems caused by this ink circulation. The ink temperature is easily increased by the circulation between the ink tank (ink fountain) and the main ink tank (ink tank) and the heat generated from the driving unit of printing apparatus. The viscosity of ink becomes low and thus the quality f printed surface may become poor.

The later invention teaches an example of ink circulation system with a cooling unit which can cool the ink in a circulating tank (ink tank). This cooling unit may prevent the quality of printed surface from becoming poor to some degree. However, when the viscosity is very high and the fluidity is relatively low, the heat is not quickly transmitted in the ink. Even if the ink is subjected to a large scaled cooling device, the heat is not smoothly transmitted because the fluidity becomes poor as temperature decreases. Also this invention can not provide sufficient effect.

In these conventional systems for circulating ink between the ink fountain and the ink tank, the ink may become tacky owing to thixotropy phenomenon of the ink per se after the circulation is not actuated for a while. Such tacky ink causes ink spreading to worsen because of poor fluidity. Thus enough ink is not applied to the printed surface, thereby causing problems such as poor quality, vague printed surface, lack of clearness, and so on.

BRIEF SUMMARY OF THE INVENTION

It is therefore an object of the present invention to provide an ink supplying device adapted for a rotary press.

Another object of the present invention is to provide an ink supplying device which can quickly set the printing condition by controlling the temperature of the ink to be supplied to a rotary press.

A further object of the present invention is to provide an ink supplying device which can control the temperature of the ink within the optimum range for printing during the printing operation to produce always excellent printing surface.

To accomplish these objects the ink supplying device according to the present invention comprises an ink cylinder, an ink feeding means for feeding ink to the ink cylinder, and an ink temperature control means for controlling the temperature of the ink to be fed to the ink cylinder within the optimum range.

The temperature control means comprises a medium circulating unit including a medium chamber, a medium temperature detecting unit, a heater and a cooler; a heat exchanger; a pipe system for circulating between the medium circulating unit and the heat exchanger; and an ink temperature detecting unit.

The heat exchanger may be selected from plate type heat exchangers.

Other objects and advantages of the present invention will become apparent during the following discussion of the accompanying drawings.

DETAILED DESCRIPTION OF THE PREFERRED EMBODIMENT

Figure 1:
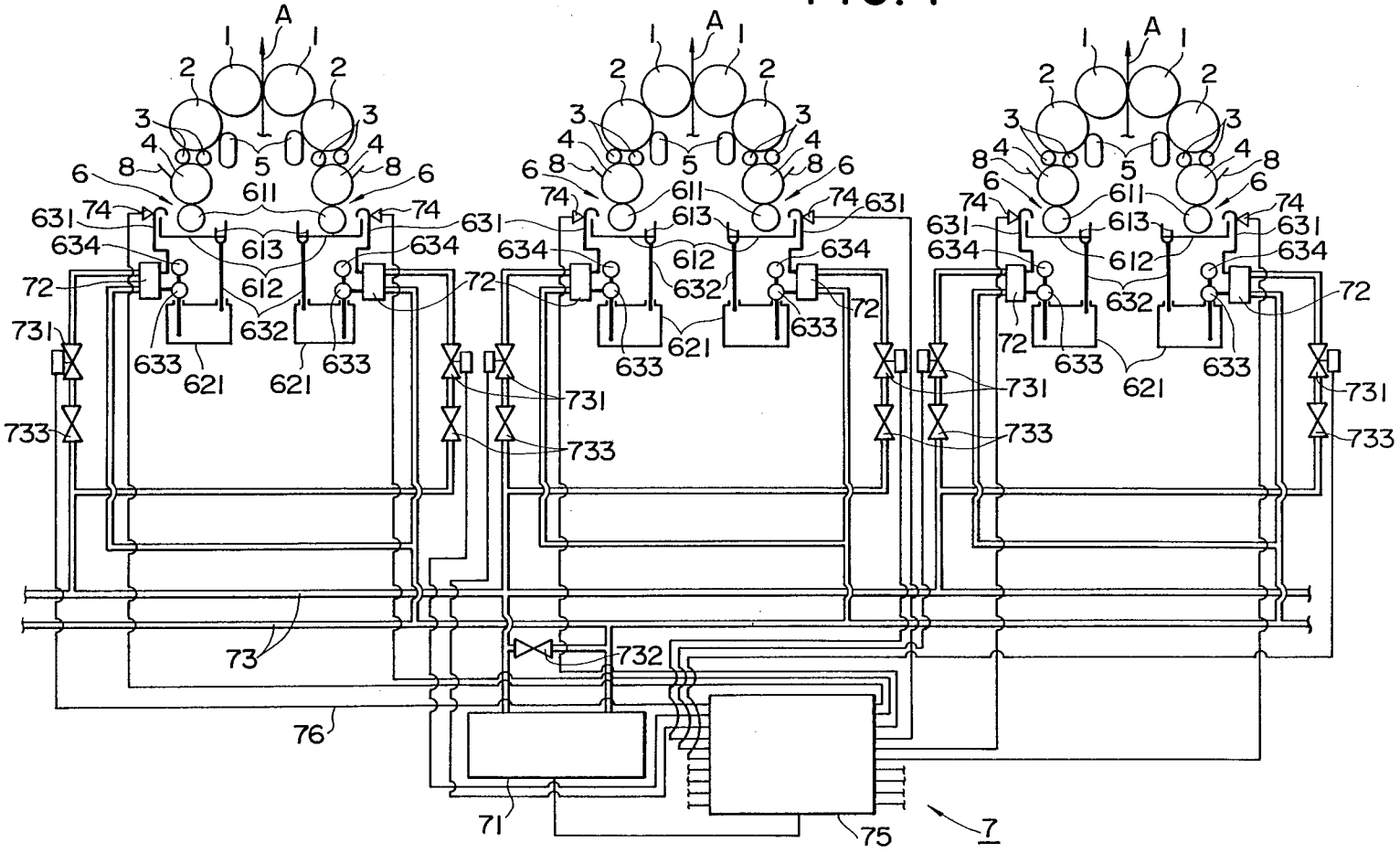
FIG. 1 is a schematic illustration showing the overall view of the ink supplying device according to a first embodiment of the present invention, wherein an ink feeding unit includes a fountain roller and an ink fountain.

One preferred embodiment of the ink supplying device according to the present invention will be discussed in conjunction with the drawings. Through the drawings the same numerals denote the same parts or corresponding elements, so that the same explanation will not be repeated. FIG. 1 is a schematic illustration showing the overall view of the ink supplying device according to a first embodiment of the present invention. In FIG. 1, the reference numeral 1 denotes a blanket cylinder, 2 denotes a plate cylinder, 3 denotes a form roller, 4 denotes an inking cylinder, 5 denotes a dampening fluid supplying means, 6 denotes an ink feeding means, and 8 denotes a doctor blade. These components constitute an offset printing machine.

A paper web A to be printed is passed through the narrow space defined between the blanket cylinder 1 forcedly pressed to the plate cylinder 2 and a printing cylinder forcedly pressed to the blanket cylinder 1, and printed by passing therethrough. Ordinarily, a impression cylinder or one of blanket cylinder 1 may serve as the printing cylinder. In this embodiment, the blanket cylinder 1 acts as the printing cylinder.

The ink feeding means 6 includes an ink feeding unit 61, an ink resevoir 62, and an ink pipe system 63 circulating between the ink feeding unit 61 and the ink reservoir 62.

In the first embodiment shown in FIG. 1, the ink feeding unit 61 includes a fountain roller 611 and an ink fountain 612. Although the feeding unit 61 may be constituted by other elements. For example, FIG. 2 and FIG. 3 employ an ink discharge nozzle 614 as the ink feeding unit 61, and FIG. 4 employs an inking chamber 615.

In FIG. 1, a sluice plate 613 is disposed in the ink fountain 612 to adjust the ink amount in the ink fountain 612.

Figure 2:
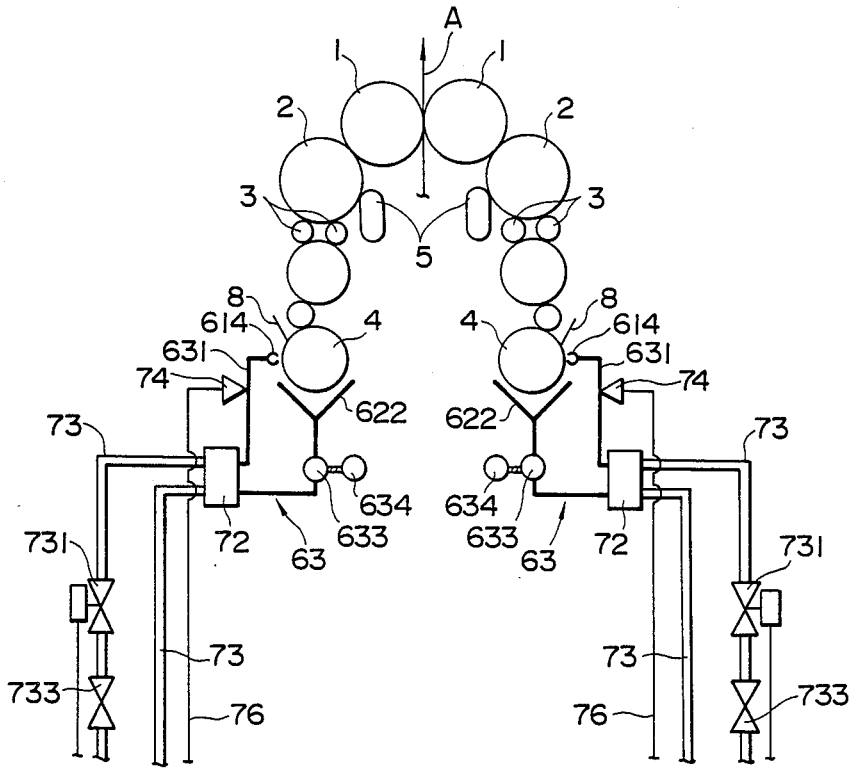
FIG. 2 and FIG. 3 are partially enlarged illustrations of printing, systems which are respective modifications of FIG. 1, wherein an ink feeding unit includes an ink injecting nozzle.
Figure 3:
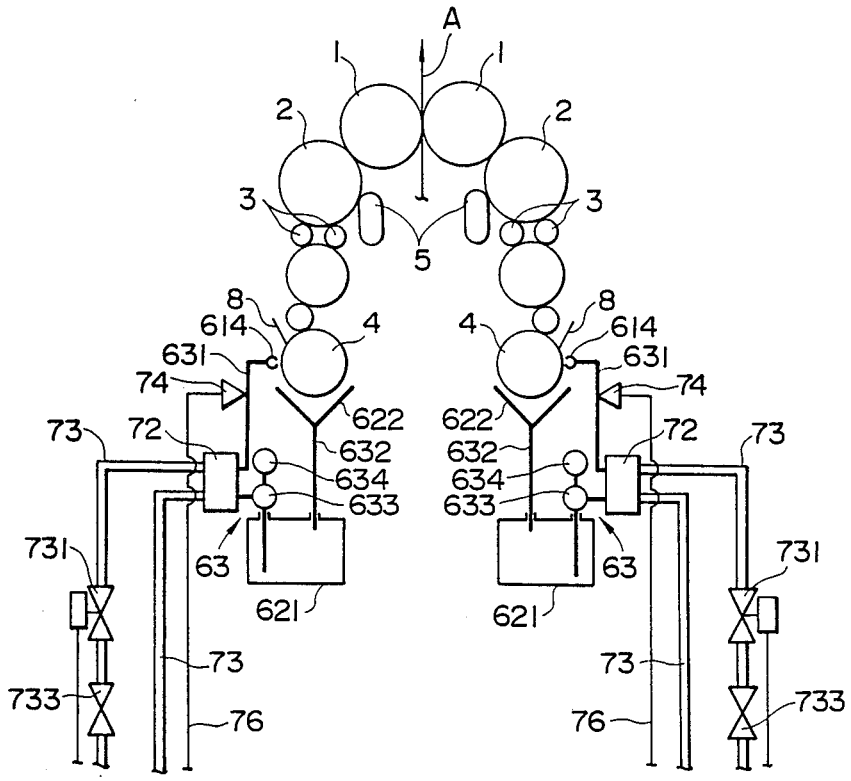
Figure 4:
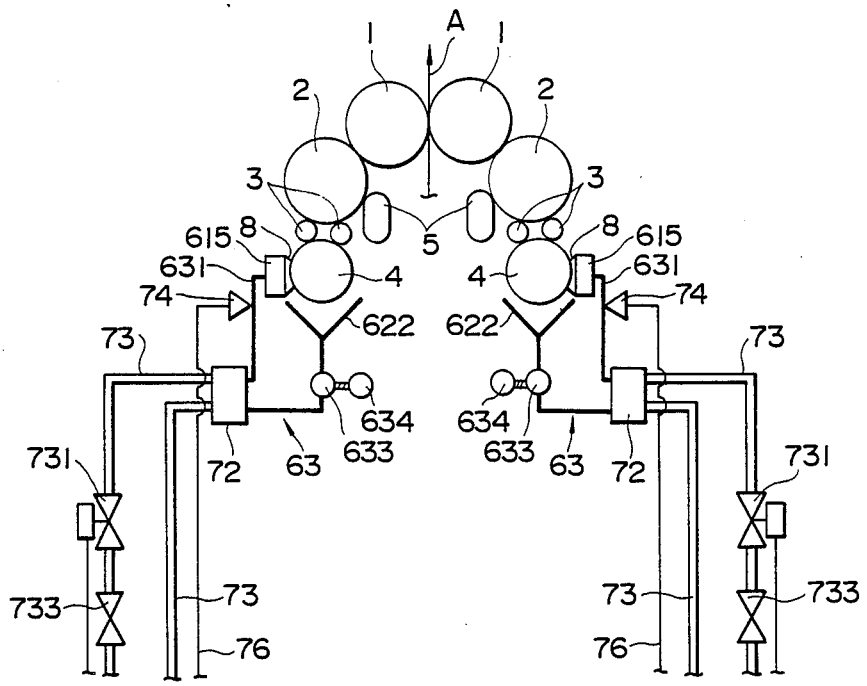
FIG. 4 and FIG. 5 are partially enlarged illustrations of printing system which are respective modifications of FIG. 1, wherein an ink feeding unit includes an ink feeding conduit.
Figure 5:
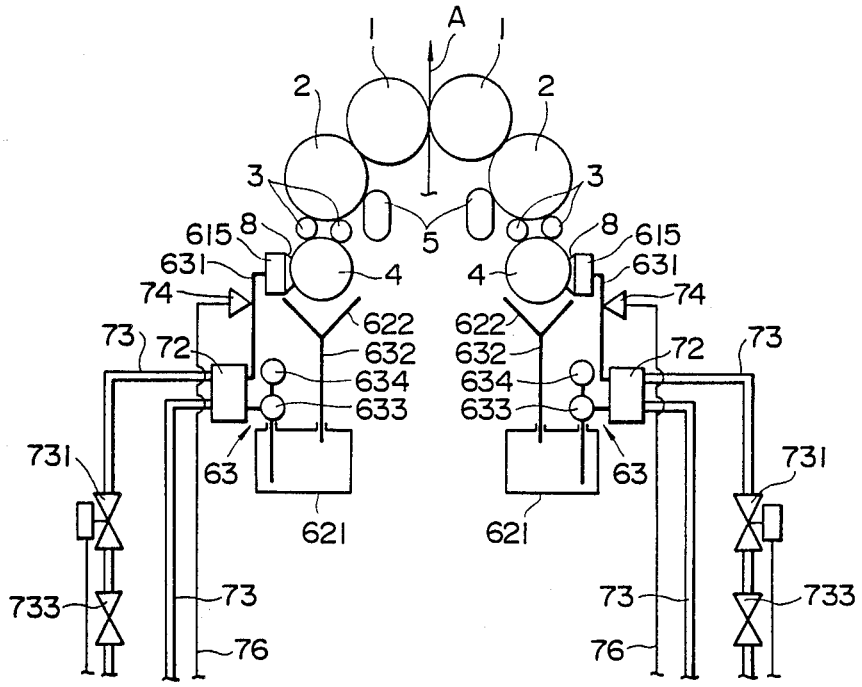

The ink resevoir 62 may be constituted by an ink tank 621 as shown in FIG. 1 and FIG. 5, an ink recovery pan 622 as shown in FIG. 2 and FIG. 4, or the combination of the ink tank 621 and the ink reservoir pan 622 as shown in FIG. 3.

The ink piping system 63 circularly communicates between the ink , reservoir 62 and the ink feeding unit 61, and comprises in ink supply pipe 631 flowing from the ink reservoir 62 to the ink feeding unit 61 and an ink return pipe 632 flowing in the reverse thereof as shown in FIG. 1, FIG. 3 and FIG. 5, or comprises an ink supply pipe 631 alone as shown in FIG. 2 and FIG. 4. The ink supply pipe 631 is provided with a pump 633, a driving motor 634 and a heat exchanger 72.

The numeral 7 denotes an ink temperature control means which comprises a medium circulation mechanism 71, a heat exchanger 72, a medium circulation pipe system 73, an ink temperature detecting unit 74, a control unit 75, and electric circuit 76.

The medium circulation mechanism 71 further includes a medium tank, a medium temperature detector, a heater, a cooler, and a medium circulating pump, not shown in the drawings. The medium circulation mechanism 71 is circulatingly communicated with the heat exchanger 72 through the medium circulation piping system 73, and electrically connected to the control unit 75 through the electric circuit 76. This embodiment employs water as the medium.

The medium circulation piping system 73 circulatingly communicates between the medium circulation mechanism 71 and the heat exchanger 72, and includes an intermediate valve 731, a relief valve 732, and a flow rate control valve 733.

The ink temperature detecting unit 74 includes a temperature sensor which is located at the downstream of the heat exchanger 72 in the ink sending pipe 631. This sensor is electrically connected to the control unit 75 through the electric circuit 76.

The control unit 75 is respectively connected to the valve 731, the heater and cooler of the medium circulation apparatus 71, and the temperature sensor of the ink temperature detecting unit 74 through the electric circuit 76 to control their operations.

Figure 7:
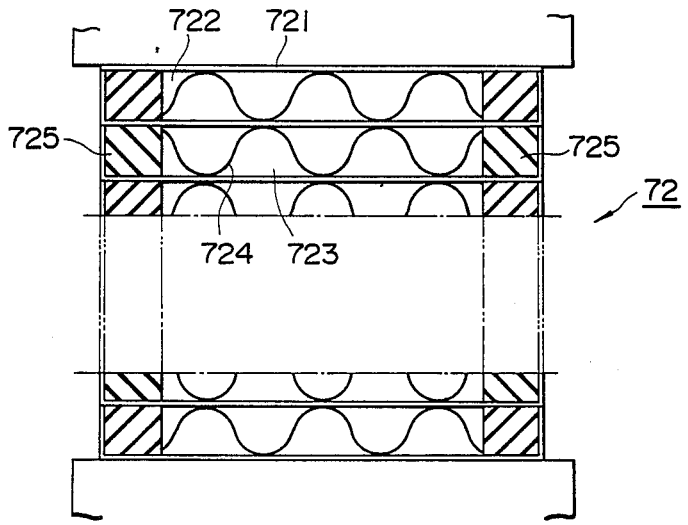
FIG. 7 is a partially cross sectional view showing a heat exchanger.

The heat exchanger 72 is a plate type heat exchanger as shown in FIG. 7, whose plate 721 is made of thin metal having a high heat conductivity. The plate 721 defines two spaces, one of them for water and the other for ink. Some plates 721 are so configured as to form the water flowing space 722 and the ink flowing space 723 alternatively. Further, each flowing spaces 722, 723 contains a wave-sectional shape mesh 724 which contacts two plates 21. Each end of the plate 721 is provided with a rubber block 725 made of neoprene which makes the spaces 722 and 23. In this embodiment, the plate 721 has a thickness of 0.6 mm, the thickness of each spaces 722, 723 is 4.0 mm, the plates 721 define eight water flowing spaces 722 and eight ink flowing spaces 723. Of course, this configuration may be varied in accordance with ink amount and so on.

Figure 8:
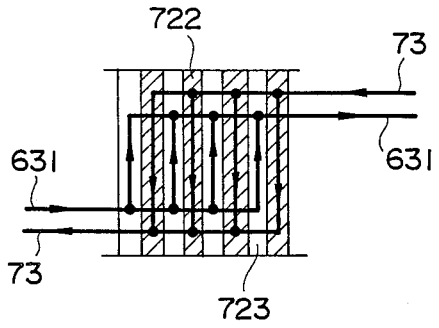
FIG. 8 is a schematic illustration showing one example of flowing directions of medium and ink through the heat exchanger.

FIG. 8 shows one example of flowing directions of water medium and ink through the heat exchanger 72.

Returning to FIG. 1, the ink in the ink fountain 612 is drawn by the fountain roller 611 and transferred to inking cylinder 4. In this embodiment, the inking cylinder 4 is a metering roller which can constantly provide ink. The doctor blade 8 contacted to the circumferential surface of the inking cylinder 4 can remove excess ink from the inking cylinder 4 to supply a predetermined amount of ink onto the printing surface of the plate cylinder 2 through the form roller 3. At the same time, the printing surface of the plate cylinder 2 is applied with dampening fluid from the dampening fluid supplying means 5. A part of the dampening fluid is transferred through the form roller 3, the inking cylinder 4 and the fountain roller 611 to the ink fountain 612 and mixed with the ink therein.

The ink in the ink fountain 612 is circulated through the ink supply pipe 631 and the ink return pipe 632. The ink in the ink supply pipe 631 is forcibly moved from the ink tank 621 to the ink fountain 612 by the pump 633 actuated by the driving motor 634. The ink return pipe 632 may be provided with an additional pump, not shown, as required. This ink circulation allows the dampening fluid mixed in the ink to uniformly disperse into its entirety.

Figure 6:
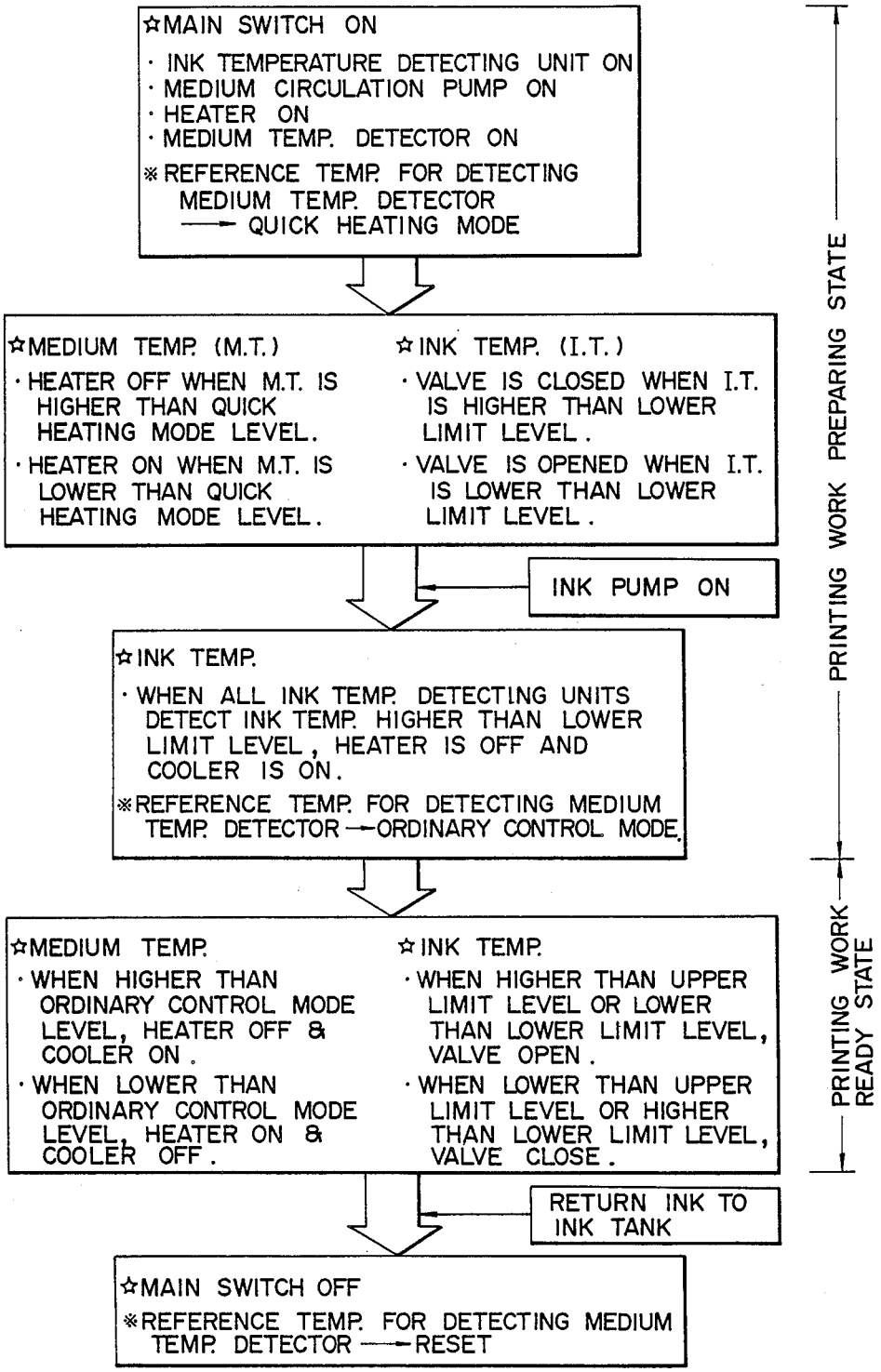
FIG. 6 is a flow chart of operation of the ink supplying device according to the present invention.

A typical operation of the first embodiment will be described below in conjunction with the flow chart shown in FIG. 6.

The printing machine is switched into a printing work preparing state as a main switch not shown is turned on. In the ink temperature control means 7, the ink temperature detecting unit 74, the heater in the medium circulation apparatus 71, the medium circulation pump, and the medium temperature detector are turned on and thus switched into their working state. At this occasion, in the control unit 75 the reference temperature for detecting the medium temperature detector is set at a quick heating mode which is previously determined.

The ink temperature control means 7 is partially actuated to increase the temperature of the medium (water in this embodiment), and then the warmed medium circulates between the medium circulation mechanism 71 and the heat exchanger 72 through the medium circulation piping system 73. The inner heater of the medium circulation apparatus 71 is alternatively turned on or off in response to the detected value of the medium temperature detector. That is, the inner heater is turned off when the medium temperature exceeds the predetermined level of the quick heating mode or turned on when it decreases the predetermined level.

During the above operation, the pump 633 is preferably driven after the medium temperature exceeds the predetermined level of the quick heating mode to supply the ink from the ink tank 621 to the ink fountain 612. The ink temperature is increased by the heat exchanger 72 arranged in the ink sending pipe 631, and detected by the ink temperature detecting unit 74. The control unit 75 compares the actual ink temperature with the lower limit level predetermined in the control unit 75. In this embodiment, the lower limit level is 28° C. The control unit 75 outputs an off signal for closing the valve 731 when the actual ink temperature exceeds the lower limit level. As the valve 731 is closed, the circulation of the medium is stopped. The heat exchanger 72 does not transmit heat to the ink. On the other hand, the valve 731 is opened when the actual ink temperature is lower than the lower limit level, and thus the warmed medium is supplied to the heat exchanger 72 to increase the actual ink temperature. According to this ink temperature adjusting operation, the ink actual temperature is maintained within the optimum range between the lower limit and upper limit levels preset in the control unit 75.

Ordinarily, the ink temperature is kept at cooled level lower than the lower level during the printing work preparing state. If the ink temperature exceeds the lower level, the valve 731 for the medium circulation piping system will be automatically closed in response to turning on of the main switch until the ink temperature will be lower than the lower limit level.

If all the valves 731 belonging to each of the ink temperature control means 7 are closed, the relief valve 732 will be opened to form a short connection of the medium circulation piping system 73.

When all temperatures detected by the ink temperature detecting unit 74 belonging to the ink temperature control means 7 exceed the lower limit level, the reference temperature for detecting medium temperature detector of the control unit 75 is switched from the quick heating mode (35° C.) to an ordinary control mode (29° C.) which is previously determined lower than the quick heating mode. At the same occasion, the heater is stopped and the cooler is operated.

After this step, when the medium temperature detected by the medium temperature detector is decreased below the ordinary control mode level, the heater is operated and the cooler is stopped. Alternatively, when the medium temperature exceeds the ordinary control mode level, the heater is stopped and the cooler is operated. The above operation is alternatively repeated.

As the ink temperature exceeds the lower limit level and the ink begins to circulate between the ink tank 621 and the ink fountain 612, the printing machine is ready to start the printing work.

When the printing machine starts working, the ink temperature is gradually increased owing to the friction heat of the ink per se generated by friction between the ink and the narrow spaces defined by the fountain roller 611 and the inking cylinder 4 in addition to the circulating friction by the pump 633, and the transmitted heat from the printing machine under working.

During the printing work of the printing machine, the ink temperature control means 7 performs the following operation.

The ordinary control mode of the control unit 75 is set into the temperature range between the lower than the ink higher limit level and the ink lower limit level to alternatively actuate the heater and the cooler so as to control the medium temperature within the predetermined range. Further, if the ink temperature detected by the ink temperature detecting unit 74 exceeds the ink higher limit level and is lower than the ink lower limit level, the valve 731 will be opened to circulate the medium to the heat exchanger 72. This operation will cool the ink supplied to the inking cylinder 4 if the ink temperature exceeds the ink higher limit level, or warm it if lower than the lower limit level to control the ink temperature within the optimum printing temperature range predetermined.

For reference, examples of predetermined temperature values effective for this invention are as follows. Generally, preferable temperature range of printing ink is about 26° C. to 34° C.

Predetermined Temperature for Medium Quick Heating Mode 35° C.

Predetermined Temperature for Medium Ordinary Control Mode 29° C.

Predetermined Temperature for Ink Upper Limit Level 30° C.

Predetermined Temperature for Ink Lower Limit Level 28° C.

According to these values the actual ink temperature on working was maintained within the preferable temperature range such as 28° to 31° C. If the ink temperature is higher than 50° C., ink properties will be changed or worsened.

When all the valves 731 belonging to the ink temperature control means 7 are closed during the printing work, the relief valve 732 is opened to perform the short circuit of the medium circulation piping system 73 in the same manner as the printing work preparing state.

Since the ink temperature may be varied in response to each the printing machine, the valve 731, belonging to the ink feeding means 6 for each of the printing, machines is acted as a control means for adjusting the circulation of the medium.

As the printing work is finished, the printing machine is stopped to return the ink from the ink fountain 612 to the ink tank 621. Then the main switch is turned off. The printing machine is released from its working state and its ink temperature control means 7 is also stopped. The reference temperatures for detecting the medium temperature detector are reset in the control unit 75.

Proceeding printing work will be started as the main switch is turned on.

As given explanation above, the control system of the present invention allows that the ink temperature is quickly adjusted to the optimum range for printing work by switching on the main switch. Further during the printing work, the ink temperature can be also maintained within the optimum range. Thus the printed quality is always kept at a high level.

This invented control system can assure that the ink supplied to the printing cylinder through the inking cylinder is kept at preferable property and quantity, and the dampening fluid to balance with the ink is also constantly fed to the printing cylinder. Thus, the confused adjusting work for the dampening fluid can be removed or simplified.

The plate type heat exchanger as shown in FIG. 7 can perform the medium circulation with much amount and a large surface area for heat transmitting so that an extremely high heat exchange efficiency can be obtained. Additionally, this type heat exchanger generates turbulent flow of the ink passing through the heat exchanger and thus the wetting water mixed in the ink is stirred and uniformly dispersed in the ink.

As many apparently widely different embodiments of this invention may be made without departing from the spirit and scope thereof, it is to be understood that the invention is not limited to the specific embodiments thereof except as defined in the appended claims.

What is claimed is:

1. An ink supplying device comprising:

an inking cylinder;

means for feeding ink to said inking cylinder;

said ink feeding means comprising an ink reservoir, an ink feeding unit and means for circulating ink between the ink feeding unit and ink reservoir;

means for controlling the temperature of the ink to be fed into the inking cylinder, comprising a medium circulation unit including a medium chamber, a medium temperature detecting unit, a heater, and a cooler; a plate-type heat exchanger; means for circulating between the medium circulation unit and the heat exchanger; an ink temperature detecting unit; and a control unit for controlling the operations of the medium circulation unit to keep the temperature of the ink within a predetermined optimum range.

2. The ink supplying device according to claim 1, wherein the means for circulating between the medium circulation unit and the heat exchanger is a piping system including an intermediate valve, which is actuated by the control unit to maintain the ink within a predetermined optimum range; a relief valve; and a flow-rate control valve.

3. The ink supplying device according to claim 2, wherein the control unit includes means for determining when the medium temperature is within a first predetermined range and means for determining when the ink temperature is within a second predetermined range.

4. The ink supplying device according to claim 3, wherein the control unit includes a quick heating mode which is actuated when the medium temperature is outside the first predetermined range.

5. The ink supplying device according to claim 4, wherein in a printing work preparing state, the intermediate valve is closed when the ink temperature exceeds the second predetermined range and is open when the ink temperature is lower than the second predetermined range, whereby, in an open condition, a medium is supplied to the heat exchanger to increase the ink temperature.

6. The ink supplying device according to claim 5, wherein, when the intermediate valve is in the closed condition, the relief valve will be in an open condition.

7. The ink supplying device according to claim 3, wherein, in a printing work ready state, the intermediate valve is open when the ink temperature is outside the second predetermined range and is closed when the ink temperature is within the second predetermined range.

8. The ink supplying device as set forth in claim 6, wherein said ink feeding unit includes a fountain roller a part of which is rotated with dipping in ink.

9. The ink supplying device as set forth in claim 6, wherein said ink feeding unit includes an ink discharge nozzle.

10. The ink supplying device as set forth in claim 6, wherein said ink feeding unit includes an inking chamber.

11. The ink supplying device as set forth in claim 6, wherein said inking cylinder includes a roller whose circumferential surface is formed with uniform and same sized recesses.

* * * * *